United States Patent [19]

Osterman

[11] 4,188,985

[45] Feb. 19, 1980

[54] STRUCTURE FOR SERVICING A PLURALITY OF MOTOR VEHICLES SIMULTANEOUSLY

[76] Inventor: Evan J. Osterman, 6920 Foothill Blvd., Tujunga, Calif. 91042

[21] Appl. No.: 855,398

[22] Filed: Nov. 28, 1977

[51] Int. Cl.[2] ..... B65B 3/04

[52] U.S. Cl. ..... 141/98; 52/169.5; 52/236.3; 137/234.6; 184/1.5

[58] Field of Search ..... 137/356, 357, 358, 359, 137/360, 361, 362, 234.6; 52/169.1, 169.2, 169.5, 236.3, 236.4, 185, 175; 184/1.5; 141/98, 392, 231–233; D25/33, 34

[56] References Cited

U.S. PATENT DOCUMENTS

| | | | |
|---|---|---|---|
| 1,582,758 | 4/1926 | Jones | 137/234.6 |
| 1,606,342 | 11/1926 | Bruce | 137/234.6 |
| 1,651,616 | 12/1927 | Morrison | 137/234.6 |
| 1,722,818 | 7/1929 | Mugler | 137/234.6 |
| 1,917,966 | 7/1933 | Gray | 137/234.6 |
| 2,102,795 | 12/1937 | Gray | 184/1.5 |
| 2,872,709 | 2/1959 | Brem | 137/234.6 |
| 3,079,871 | 3/1963 | Brodie | 137/234.6 |

FOREIGN PATENT DOCUMENTS

| | | | |
|---|---|---|---|
| 459755 | 9/1949 | Canada | 137/234.6 |
| 291715 | 6/1928 | United Kingdom | 137/234.6 |

*Primary Examiner*—Houston S. Bell, Jr.
*Attorney, Agent, or Firm*—Wm. Jacquet Gribble

[57] ABSTRACT

A multi-level building has a plurality of service bays each having upper and lower work floors both surrounded by walls. The upper work floor has a floor aperture with roller mounted horizontal gates to open and close the aperture. The gates are capable of supporting lift jacks and taking the weight of the motor vehicle. The upper work surface received the motor vehicle. A moveable door in one end wall of the bay precludes unauthorized removal of the motor vehicle. Tanks remote from the work surfaces are connected to fluid collectors operable from the lower work surface. Upper and lower access drives are connected by ramps for the entry and exit of vehicles and the delivery of supplies and removal of waste. Other doors and gates deny unauthorized access to the work surfaces. The bays may be arranged in side-by-side or tandem relationship with access ways between tandem bays such that a vehicle may move from one bay to another or be removed from the structure without passing through the second bay.

6 Claims, 5 Drawing Figures

12
33
11
32
31
29
22
34
19
46
29
33
29
2
41
28
41
15
45
21
41
16
45
21
19
17
13
2
26
36

11
46
22
24A
55
28
-21-
29A
45
51
54
17
12
33
31
53
23
26
59
41
56
57
24B
58
47
49
13
42
25
48

STRUCTURE FOR SERVICING A PLURALITY OF MOTOR VEHICLES SIMULTANEOUSLY

BACKGROUND OF THE INVENTION

The invention relates to servicing of motor vehicles and more particularly to a building or structure within which vehicles can be efficiently lubricated, repaired, or tuned without the necessity of hoisting the vehicle in order to achieve access to the underside thereof. Periodic service is presently done from a personnel confining pit or with an automobile hoisted, which is either inconvenient or denies access to the upper portion of the motor vehicle while the lower portion is being serviced, with the consequent increase in the service time. These handicaps and barriers to efficient service are overcome in the instant invention by the provision of two work levels, one above the other, and one or more work stations so separated that specialized tools may be conveniently at hand in a succession of work bays.

SUMMARY OF THE INVENTION

The invention contemplates a motor vehicle service structure having upper and lower work surfaces surrounded by walls, the upper surface having an access well closeable by moveable horizontal gates, said gates being such that they can bear the weight of the vehicle being serviced. Fluid collection means operable from the second lower work surface connect to a bulk collection point or tank. A lockable door in an exit of the upper work surface precludes unauthorized removal of the vehicle. Entrance and exit drives surround the walls of the structure and ramps connect to the surrounding drives from one level to another. Access means such as stairways for personnel are provided between levels also.

In a preferred embodiment a plurality of bays is arranged in both parallel and tandem order, with vehicle drive areas between and around the bays such that vehicles may be transferred from one tandem bay to another for specialized service.

Because of the various work levels and work stations all parts of the vehicle may be serviced simultaneously and in rapid fashion. By having separated bays with specialized tools or personnel speedy and efficient repairs as well as periodic maintenance can be accomplished in comfortable and safe fashion for the personnel employed.

These and other advantages of the invention are apparent from the following detailed description and the drawing.

BRIEF DESCRIPTION OF THE DRAWING

In the various Figures, like reference numbers are used to indicate like parts.

DESCRIPTION OF THE PREFERRED EMBODIMENTS

Figure 1:
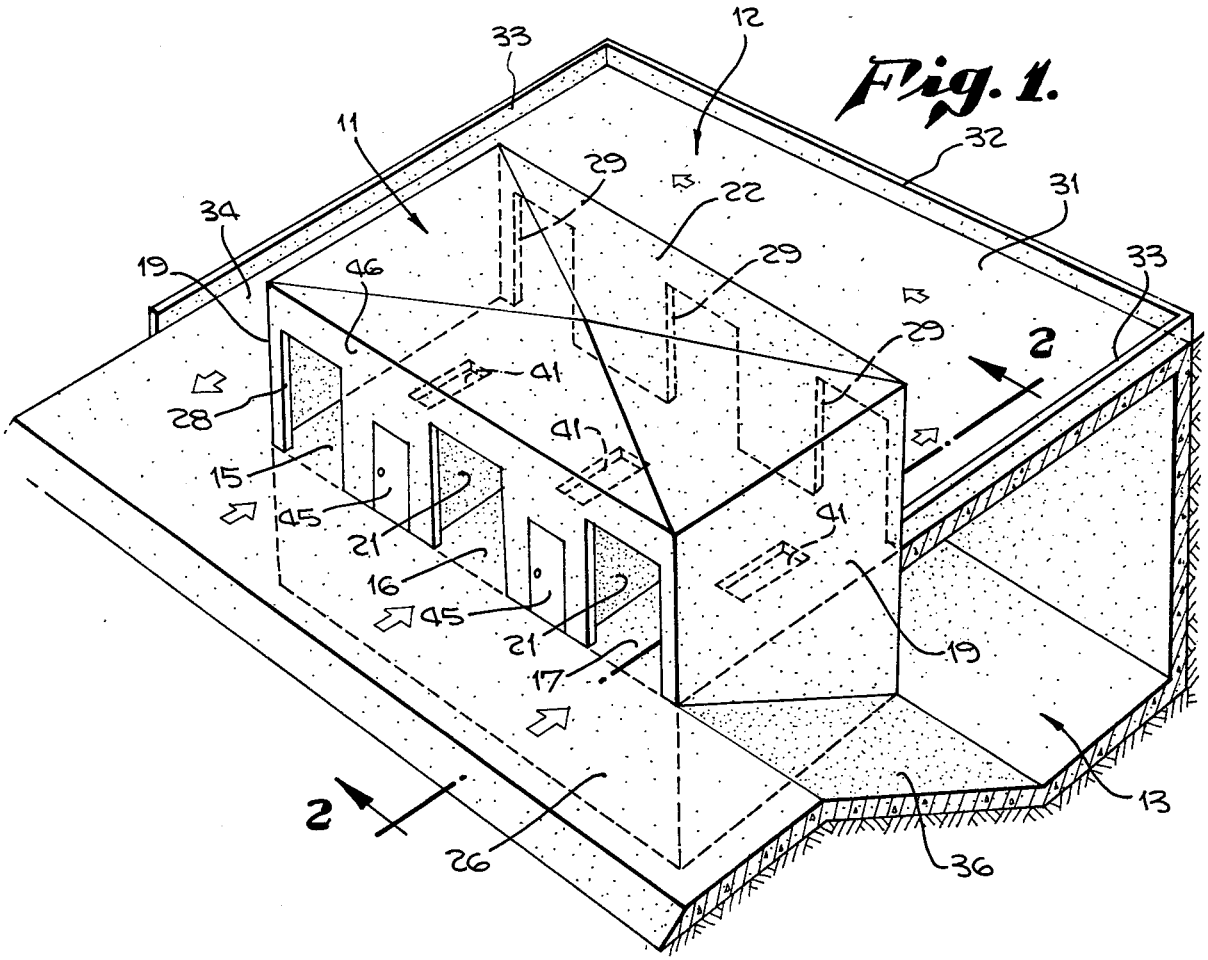
FIG. 1 is a perspective view partly broken away of a structure in accordance with the invention having three service bays.
Figure 2:
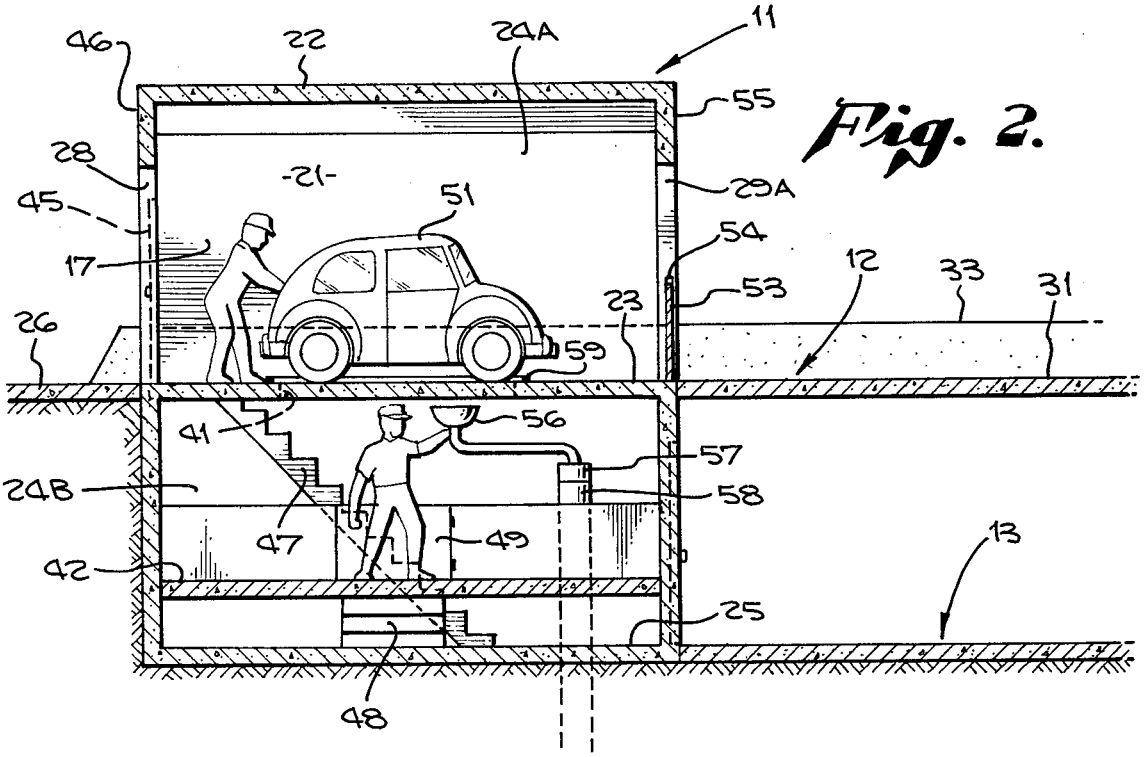
FIG. 2 is a sectional elevation taken along line 2—2 of FIG. 1.

In FIGS. 1 and 2 a service structure 11 has an upper level 12 and a lower level 13 which support a plurality of work bays 15, 16 and 17.

Work bays 15 and 17 have side walls 19 and the work bays have separation walls 21. A roof 22 covers the upper portion of the bays and a structural floor 23 divides each work bay into upper and lower work stations 24A, 24B above a base 25. An access apron 26 affords entrance to each of the three service bays through doorways like doorway 28 of service bay 15. Each service bay has an exit door 29 shown in dotted lines in FIG. 1 and indicated at 29A in FIG. 2. Each exit door 29 leads on to a drive 31 surrounded by bumper walls 32,33 which confine traffic to a semi-circular pattern including an exit drive 34. Adjacent the exterior of service bay 17 is a ramp 36 giving access to lower service level 13.

Shown in dotted lines in each service bay is an access well 41 which is located centrally above a lower work floor 42. The lower work floor is walled and gated and accessible from apron 26 through one of lockable doors 45 in a front wall 46 of the structure. Doors 45 open onto descending staircase 47 which give access to level 13 and also give access to ascending staircase 48 which leads to gate 49 of work floor 42.

Work floor 42 is spaced from structural floor 23 such that service personnel standing on the lower floor 42 can conveniently work upon the under components of motor vehicles such as a vehicle 51 shown in FIG. 2 over access well 41 of bay 17.

The arrangement of the structure is such that customer convenience facilities (not shown) may be located on the lower level, say below exit drive 34. Such conveniences may include a cashier's cage, food and beverage dispensing machines or counters, restrooms and a limited lounge. The purpose of the gates 49 at each work floor 42 is to preclude entry by unauthorized personnel. In each exit doorway 29 of a bay, a pocket door 53 is slidable into a pocket 54 in rear wall 55. It is contemplated that the pocket door be lockable to preclude removal of the vehicle without authorization to the service personnel on the upper level 12, such as a cashier's receipt or other pass.

The service bays 15–17 in the embodiment of FIG. 1 are primarily for accomplishing periodic maintenance of vehicles, such as changing crank case oil, lubricating various chassis and motor points, draining and flushing transmissions and adding or changing differential and transmission greases. For these purposes a fluid collector 56 is provided on a swivel mount 57 for draining waste fluids from crank cases, transmissions and radiators. Such fluids may be conducted by conduit 58 to a common collector or disposal point, or may be separately collected and stored in reclamation tanks for further processing at another situs.

In order to preclude debris and waste from readily entering the access wells 41, each well is surrounded by an upstanding curb 59, the transverse width of which is less than the track of the smallest vehicle contemplated for service. In addition it is contemplated that the wells be closable by horizontal gates which are preferably capable of supporting the weight of the automobile if it is found necessary to raise a portion or all of the vehicle above the upper work floor 23.

Figure 3:
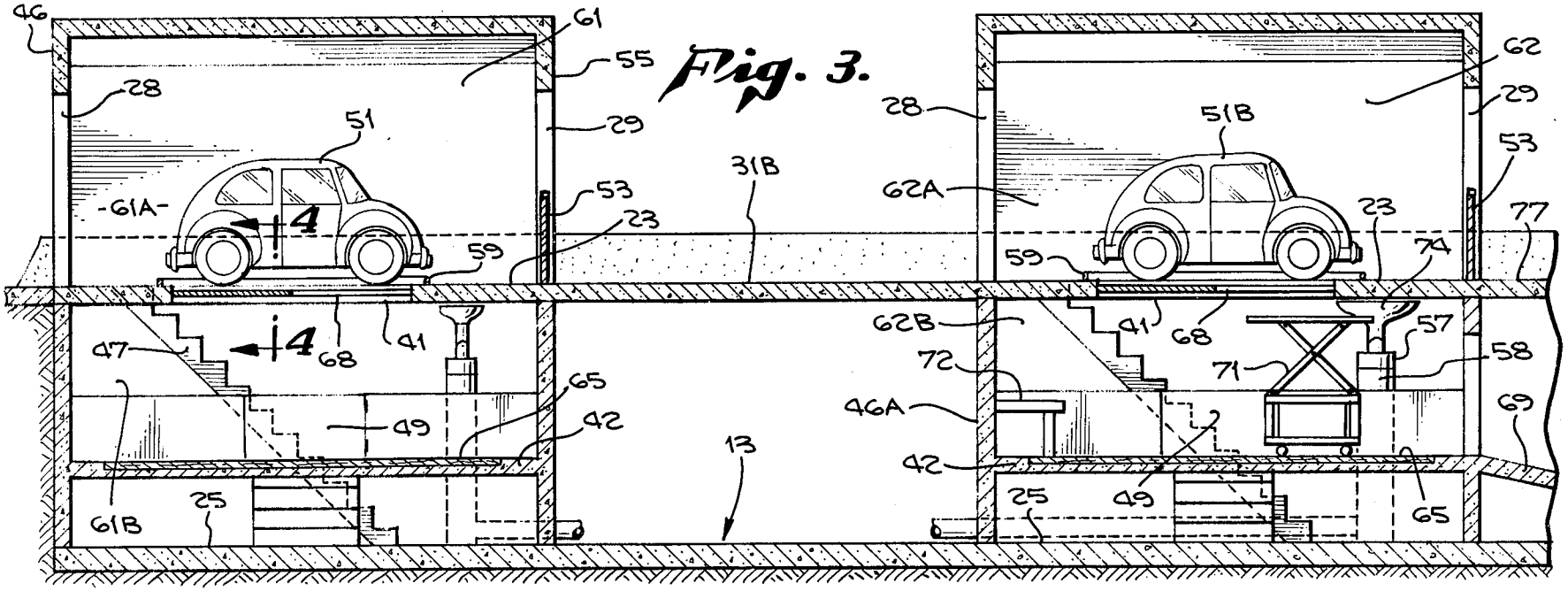
FIG. 3 is a longitudinal sectional elevation, partly broken away, of an alternate embodiment of the invention having tandem service bays.
Figure 5:
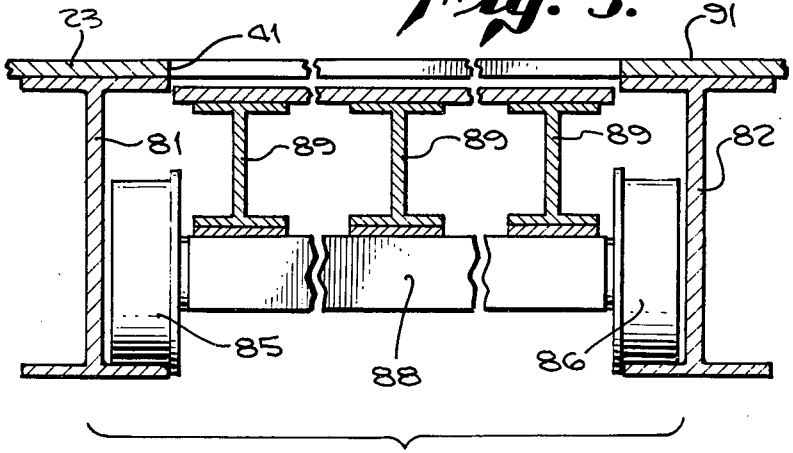
FIG. 5 is a fragmentary longitudinal sectional elevation taken along line 5—5 of FIG. 4.
Figure 4:
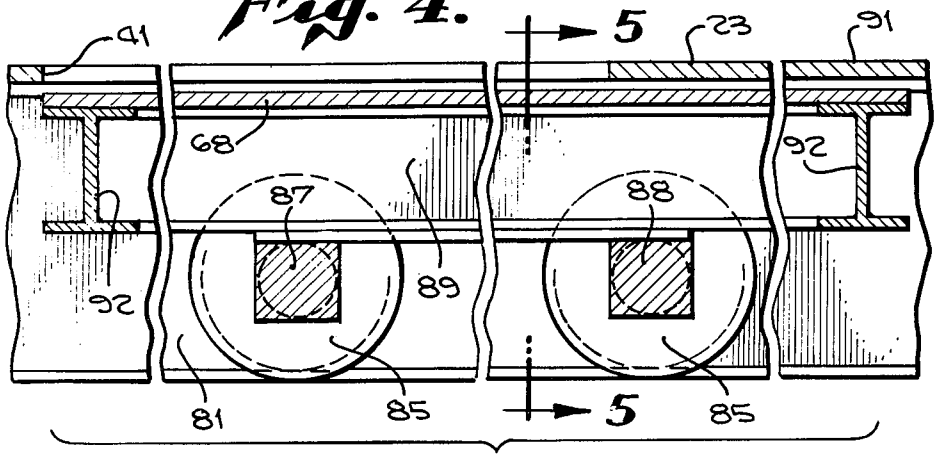
FIG. 4 is a fragmentary transverse sectional elevation taken along line 4—4 of FIG. 3 and showing the roller-mounted horizontal gates.

The operation of the horizontal gates of the access well of each bay can be better understood with respect to the alternate embodiment shown and described in FIGS. 3,4, and 5. In FIG. 3, tandem service bays 61, 62 each have upper and lower work stations 61A, 61B and 62A, 62B respectively. The work stations 61A, 61B are substantially similar to the upper and lower work stations 24A, 24B of bay 17 described previously with respect to FIG. 2, having front and rear walls 46,55 respectively, entry and exit doors 28, 29, and controlled exit pocket door 53. Each of the tandem bays has an upper structural floor 23 and lower base 25. A raised or cantilevered access drive 31B extends between the upper floors 23 of the bays. Each of the lower work stations 61B, 62B has a slightly raised work floor 42, preferably surfaced with rough-sawn planking 65 to afford an easily cleaned non-slip surface for personnel. Upper floor 23 of each of the tandem bays has an access well 41 surrounded by a curb 59. Rolling gates 68 may be positioned to close the access well.

Lower work station 62B of bay 62 may differ from the previously described work bays in having a lower loading ramp 69 connecting to work surface floor 42 such that jacking equipment, like the transmission receiver 71 shown schematically in FIG. 3, and other like devices may be moved onto the lower work floor below a vehicle 51B shown within the service bay. A work or tool bench 72 may be placed against the front wall 46A of the tandem work bay 62 for the convenience of personnel. Swivel mount 57 of conduit 58 may receive a specialized connector 74 expressly for use of draining and flushing automatic transmissions.

It is contemplated that the exemplary structure shown in FIG. 3 may receive a vehicle 51 in the periodic service bay 61 which, after service, will be moved past pocket gate 53 and across access drive 31B into service bay 62 for specialized mechanical overhaul or other repair. After the overhaul or other repair has been completed pocket door 53 of bay 62 is opened and the car, after proper authorization, may be removed through doorway 29 onto drive 77 and thence counterclockwise to an exit drive such as the drive 34 of FIG. 1.

It is contemplated that the access wells 41 be greater in dimension in the longitudinal axis of the structure to accommodate the narrow track of smaller vehicles and still give access to the entire lower surfaces of a vehicle. Therefore, as shown in FIGS. 4 and 5, I beams 81,82 which may be structural members of the floor 23, extend adjacent the longitudinal ends of the access well and receive horizontal gate rollers 85,86 which are paired on each I beam to support parallel, spaced square trucks 87, 88 from which smaller I beams 89 support the horizontal gates 68.

Preferably each access well is closed by two transversely moving gates 68, each gate being mounted upon four rollers, 85, 86 with two square trucks 87,88. The gates thus meet along the longitudinal line in the center of the well and each gate need only be moved transversely half the width of the well.

As stated before the gates 68 are preferably such that jacks or lifts may be rested upon them to raise all or part of the vehicle from the horizontal gates. For this reason it is preferred that each gate be made from iron plate of 5/16" thickness and about 6' long by 4' wide. The wheels may have a diameter of 4 inches and run on I beams having a six inch depth.

For the purposes of clearance the horizontal gates are preferably ¼ of an inch below the bottom surface of the half inch aluminum plates 91 which may form the upper surface of upper structural floor 23. For additional structural strengthening support I beams 89 are butt-welded to terminal I beams 92 at each side of each gate plate.

It is to be understood that the horizontal gate structure is exemplary only and that other steel and iron structural forms may be used without departing from the spirit of the invention.

While the structure is indicated in the drawings as largely made of concrete, the invention does not preclude the use of other structural materials to form the walls and floors.

Other variations within the scope of the invention may occur to those skilled in this particular art. It is therefore desired that the invention be measured by the appended claims than by the illustrative embodiments disclosed herein.

I claim:

1. In a motor vehicle service structure having a plurality of service bays defined by end and side walls the combination comprising for each bay a front entry, a rear entry, a rear entry closure; a first support floor, an access well in the first support floor, horizontally movable closure gates for the access well; a second support floor vertically spaced from the first support floor, personnel access means between floors, supply access means between floors, means selectively precluding personnel access to said second support floor, and access drives for vehicles to and from said plurality of service bays.

2. A service structure in accordance with claim 1 wherein said service bays are adjacent and parallel.

3. A service structure in accordance with claim 2 further comprising a second plurality of service bays arranged in tandem with said first plurality of service bays, and access drives between said first and second pluralities of service bays.

4. A service structure in accordance with claim 1 further comprising a work surface raised above said second support floor beneath each of said access wells.

5. A service structure in accordance with claim 4 further comprising fluid collector means operable from said raised work surface.

6. A service structure in accordance with claim 1 wherein each of said access gates comprise parallel guide rails beneath and bordering said access well, a plurality of rollers on said rails, beam means extending between rollers from rail to rail, supports on said beam means, and a plate secured to said supports movable with said rollers.

* * * * *